US006377218B1

(12) United States Patent
Nelson et al.

(10) Patent No.: US 6,377,218 B1
(45) Date of Patent: Apr. 23, 2002

(54) DEVICE FOR PROVIDING AN ANTENNA, A RECEPTACLE, AND A PHYSICAL CONNECTOR ON A TYPE II PCMCIA CARD

(75) Inventors: Jon A. Nelson, Bluffdale; Edward Hughes, Grantsville, both of UT (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/684,286

(22) Filed: Oct. 4, 2000

(51) Int. Cl.[7] ..... H01Q 1/24
(52) U.S. Cl. ..... 343/702; 343/906
(58) Field of Search ..... 343/702, 700 MS, 343/906; 455/90, 89; 439/98, 916, 584

(56) References Cited

U.S. PATENT DOCUMENTS 5,657,028 A * 8/1997 Sanad ..... 343/700 MS
5,929,815 A * 7/1999 Elderfield ..... 343/702
6,181,284 B1 * 1/2001 Madsen et al. ..... 343/702

* cited by examiner

*Primary Examiner*—Don Wong
*Assistant Examiner*—James Clinger
(74) *Attorney, Agent, or Firm*—Wagner, Murabito & Hao LLP

(57) ABSTRACT

A peripheral component providing multiple types of interfaces. In one embodiment, the peripheral component comprises a housing with logical circuitry within. A receptacle is electrically connected to the logical circuitry. The receptacle may be operable to receive an RJ-11 plug and/or an RJ-45 plug. A wireline interface, for example, a 15-pin connector, is also electrically connected to the logical circuitry. Furthermore, a resilient antenna is electrically connected to the logical circuitry. The antenna is operable to conform to fit inside the housing, and when extracted, the antenna is operable to return substantially to a pre-determined shape, wherein reception and transmission of a wireless signal are optimized. In one embodiment, the logical circuitry of the peripheral component comprises a wireless device, for example, a Bluetooth™ device. In another embodiment, the peripheral component is a type II PCMCIA card. In still another embodiment, the receptacle is an X-Jack™. In still another embodiment, the wireline interface is adapted to receive a 15-pin connector.

20 Claims, 6 Drawing Sheets

DEVICE FOR PROVIDING AN ANTENNA, A RECEPTACLE, AND A PHYSICAL CONNECTOR ON A TYPE II PCMCIA CARD

TECHNICAL FIELD

The present invention relates to network interface cards. In particular, the present invention pertains to a device that provides an antenna for wireless transmission on a peripheral component (e.g., a type II PCMCIA card), along with a receptacle (e.g., an X-Jack™) and a wireline connector (e.g., a 15-pin connector).

BACKGROUND ART

Computers have become an integral tool used in a wide variety of different applications, such as in finance and commercial transactions, computer-aided design and manufacturing, health care, telecommunication, education, etc. Computers are finding new applications as a result of advances in hardware technology and rapid development in software technology. Furthermore, a computer system's functionality is dramatically enhanced by connecting it to a network, another computer, or a device such as a FAX machine. This allows the computer to exchange files; share information stored on a common database; connect to the Internet; and communicate via FAXes, e-mail, and teleconferencing.

In some instances, in order make such connections, a peripheral component generally known as a network interface card (NIC) must be inserted into the general purpose computer. The NIC may provide multiple ways to make such connections. For example, the NIC may have a receptacle for plugging in a jack which interfaces with a modem, LAN, or ISDN. Alternatively, a wireline connector on the NIC may allow a connection via a parallel cable, a serial cable, a SCSI cable, etc. to another device. Essentially, the peripheral component works with the operating system and central processing unit (CPU) of the host computer to control the flow of information over the various types of connections.

In addition to the two type of connections listed above, it is becoming increasingly desirable to provide a wireless connection to a peripheral component. Unfortunately, peripheral components, such as PCMCIA cards have very limited space. Wireless interfaces, such as antennas, have been added to some conventional peripheral components, but at the expense of removing either the receptacle or the wireline connector (e.g., a 15-pin connector.

Other conventional solutions have modified the 15-pin connector, for example, providing for fewer pins. Unfortunately, this may make the connector incompatible with some technologies.

Another conventional technique used to add a wireless interface to a peripheral component is to move the location of the receptacle. For practical reasons, all of the interfaces must be at one end of the peripheral component. One conventional solution moves the receptacle from the left edge of the interface end to the middle of the interface end. However, this may interfere with the circuitry inside the peripheral component, a component with very limited internal space.

The above problems are exceptionally difficult to deal with when the peripheral component is a type II PCMCIA card, as the size and shape of the card is both limited and fixed by standards.

Accordingly, a need exists for a peripheral component which has multiple types of interfaces. In particular, a need exists for a peripheral component with a receptacle interface, a wireline connector interface, and a wireless interface. A further need exists wherein such a peripheral component is a type II PCMCIA card. A further need exists for such an apparatus which interferes minimally with the circuitry inside of the peripheral component.

DISCLOSURE OF THE INVENTION

The present invention provides a peripheral component providing multiple types of interfaces. Embodiments of the present invention provide for a peripheral component with a receptacle interface, a wireline interface, and a wireless interface. Embodiments provide for a such a peripheral component being a type II PCMCIA card. Embodiments provide for such as device which interferes minimally with the logical circuitry inside the peripheral component.

A peripheral component providing multiple types of interfaces is disclosed. In one embodiment, the peripheral component comprises a housing with logical circuitry within. A receptacle is electrically connected to the logical circuitry. The receptacle may be operable to receive an RJ-11 plug and/or an RJ-45 plug. A wireline interface, for example, a 15-pin connector, is also electrically connected to the logical circuitry. Furthermore, a resilient antenna is electrically connected to the logical circuitry. The antenna is operable to conform to fit inside the housing, and when extracted, the antenna is operable to return substantially to a predetermined shape, wherein reception and transmission of a wireless signal are optimized.

In another embodiment, the receptacle is within a platform having a groove into which the antenna slideably fits. In one embodiment, the receptacle platform slideably extracts from and inserts into the housing, along with the antenna.

In one embodiment, the logical circuitry of the peripheral component comprises a wireless device, for example, a Bluetooth™ device.

In another embodiment, the peripheral component is a type II PCMCIA card. In still another embodiment, the receptacle is an X-Jack™. In still another embodiment, the wireline interface is adapted to receive a 15-pin connector.

These and other objects and advantages of the present invention will become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail so as not to unnecessarily obscure aspects of the present invention.

Figure 1:
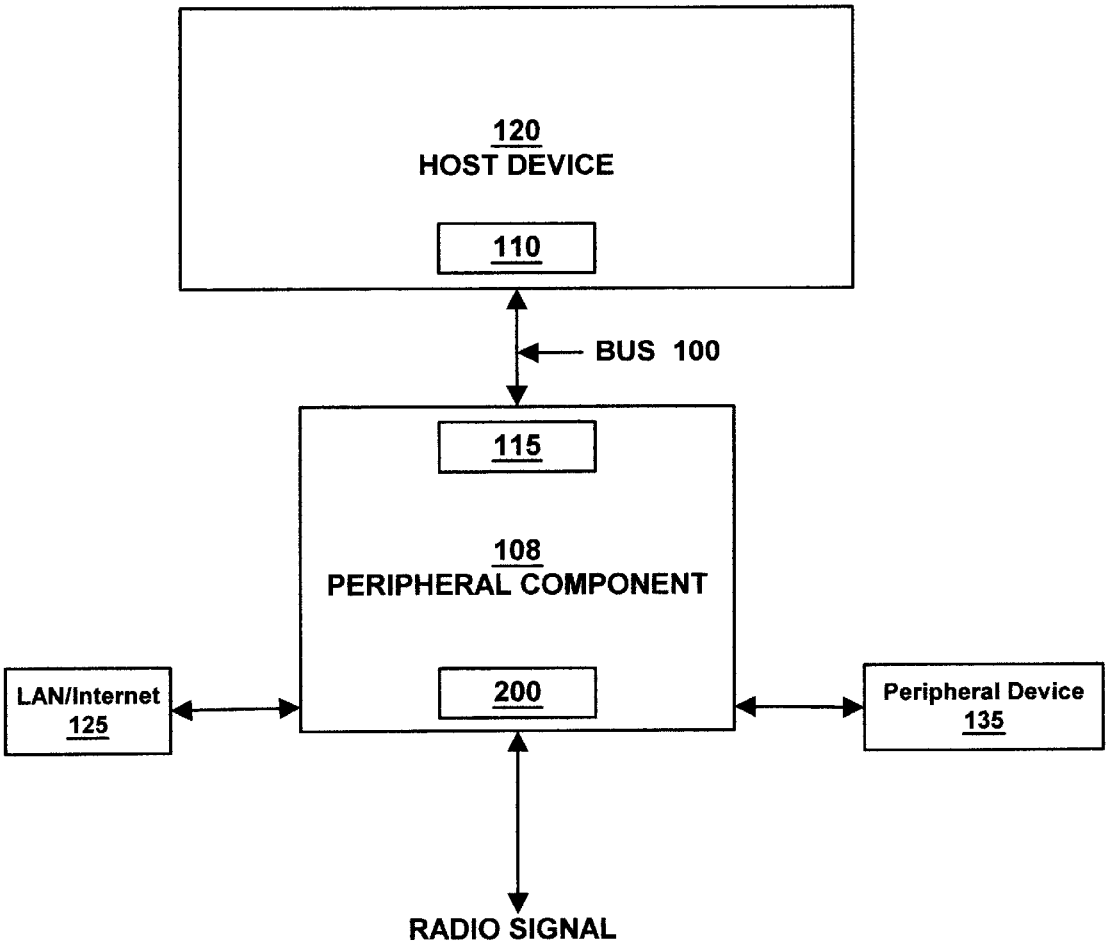
FIG. 1 is a block diagram of a peripheral component with various connections, according to one embodiment of the present invention.

FIG. 1 is a block diagram showing a peripheral device 108 coupled to a host device 120 in accordance with the present embodiment of the present invention. Host device 120 is an intelligent electronic device such as a computer system (laptop or desktop) or any of a variety of other devices for which the ability to interface with other devices over multiple types of connections is desired. The peripheral component 108 may be inserted into a slot in the host device 120, leaving one end of the peripheral component 108 exposed. Therefore, various connections may be made to the peripheral component 108.

In the present embodiment, peripheral component 108 is a type II PCMCIA card. The peripheral component 108 has three different types of interfaces on it. For example, the peripheral component 108 has a receptacle interface, which is an X-Jack™ in a preferred embodiment. In other embodiments, the receptacle is any receptacle suited to receive an RJ-11 plug and/or an RJ-45 plug. The receptacle allows the host computer 120 to connect through a phone line (RJ-11) or Ethernet connection (RJ-45) to, for example, the Internet or a LAN 125. The receptacle may also be suitable for an ISDN connection, a Digital Subscriber Line connection (DSL), or the like.

The peripheral component 108 also comprises a wireline connector. The wireline connector is suitable for any of a number of well known communication standards and protocols, e.g., serial, parallel, SCSI, Firewire (IEEE 1394), etc. In a preferred embodiment, wireline connector is a 15-pin connector. In different embodiments, the wireline connection allows the host computer 120 to interface with a peripheral device 135 via one of the various wireline interfaces, for example, a serial interface, a parallel interface, a SCSI interface, an IEEE 1394 interface, etc.

The peripheral component 108 also has a wireless interface. In one embodiment, this is an antenna for sending and receiving wireless signals. The antenna couples to a radio frequency (RF) device 200. In a preferred embodiment, the device 200 is a Bluetooth™ device comprising a digital component (e.g., a Bluetooth™ controller) and an analog component (e.g., a Bluetooth™ radio). In another embodiment, the device 200 is a "Bluetooth-enabled" device; that is, a device adapted to communicate with Bluetooth™ devices. In other embodiments, other types of short-range RF modules may be used. For example, devices which comply with the IEEE 802.11 Wireless Local Area Network Standard or IEEE 802.15 Wireless Personal Area Network Standard, or the like may be used as well. However, the present invention is not to be limited to transmitting at a "Bluetooth frequency" (e.g., about 2.4 GHz–2.5 GHz). Rather, embodiments of the present invention are well suited to wireless transmission at a variety of frequencies, for example, Global System for Mobile Communications (GSM) (e.g., approximately 900 MHz, 1.8 GHz, or 1.9 GHz), Personal Communication Services (PCS) (e.g., approximately 1.8 GHz–2 GHz), U.S. cellular (e.g., approximately 824 MHz–854 MHz), European cellular (e.g., approximately 880 MHz–960 MHz), etc.

In accordance with the present invention, peripheral component 108 and host device 120 are coupled via a single bus 100. Peripheral component 108 can be coupled to computer system 120 using any of a variety of physical bus interfaces (e.g., host interface 110, peripheral interface 115), including but not limited to a Universal Serial Bus (USB) interface, Personal Computer (PC) Card interface, CardBus or Peripheral Component Interconnect (PCI) interface, mini-PCI interface, Personal Computer Memory Card International Association (PCMCIA) interface, Industry Standard Architecture (ISA) interface, or RS-232 interface. In the present embodiment, interface 110 runs software (e.g., a virtual device driver) that allows peripheral component 108 to interface with the operating system of the host device (e.g., computer system 120). In a preferred embodiment, the bus 100 is a Personal Computer Memory Card International Association (PCMCIA) interface.

Figure 2:
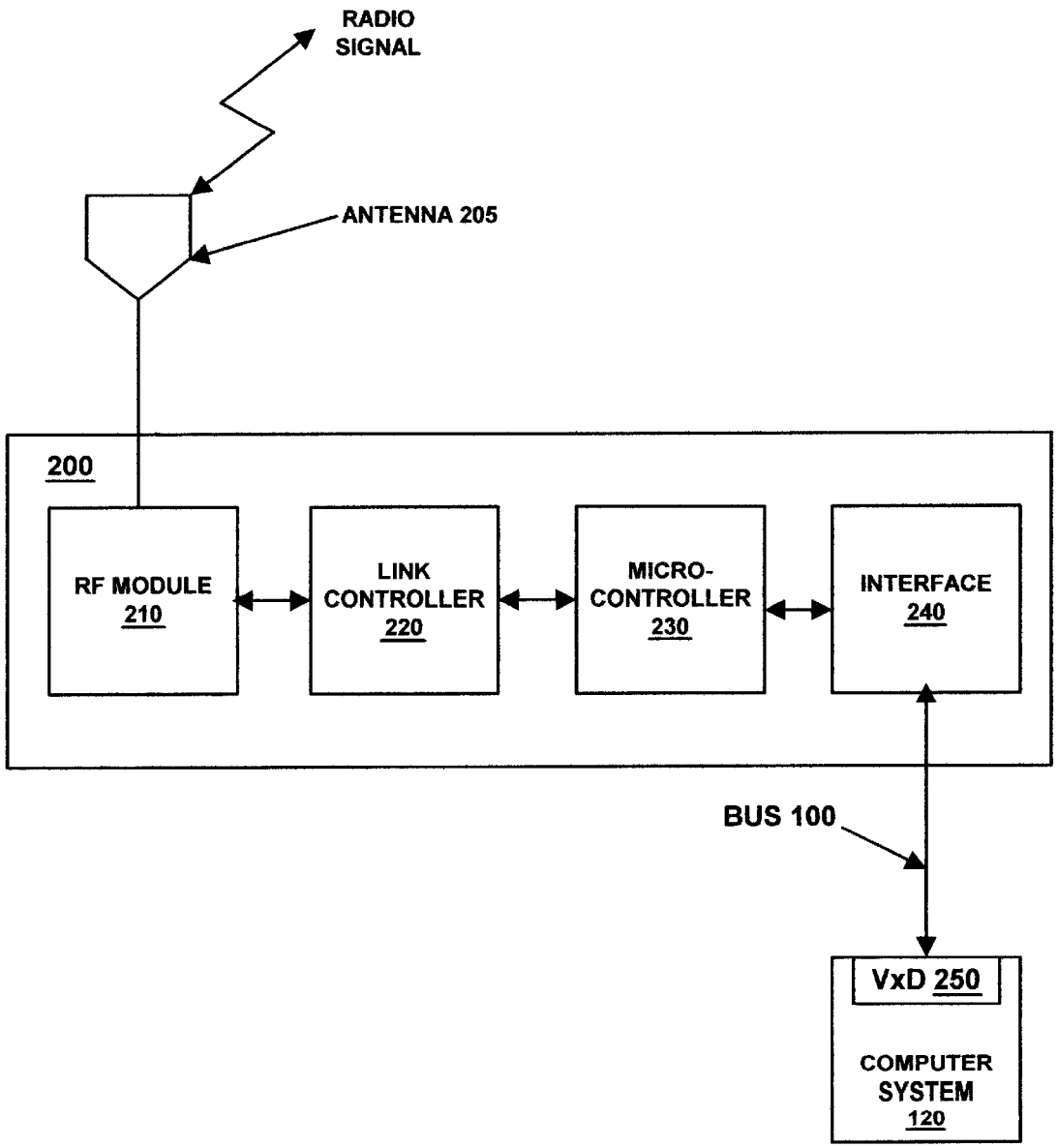
FIG. 2 is a block diagram of an exemplary radio frequency device and an antenna, in accordance with an embodiment of the present invention.

FIG. 2 is a block diagram of RF device 200 with an antenna 205 coupled to it, in accordance with one embodiment of the present invention. In one embodiment, RF device 200 is a radio transceiver. In a preferred embodiment (the "Bluetooth™ embodiment"), RF device 200 is a Bluetooth™ device or Bluetooth-enabled device comprising a radio frequency (RF) module 210, a link controller 220, a microcontroller (or central processing unit) 230, and an external interface 240. In the present embodiment, RF device 200 is coupled to a host device (e.g., computer system 120) by a system bus 100.

In the Bluetooth™ embodiment, RF module 210 is a Bluetooth™ radio. The Bluetooth™ radio can provide a bridge to existing data networks, a peripheral interface, and a mechanism to form small private groupings ("piconets") of connected devices away from fixed network infrastructures.

In the present embodiment, link controller 220 is a hardware digital signal processor for performing baseband processing as well as other functions such as Quality-of-Service, asynchronous transfers, synchronous transfers, audio coding, and encryption.

In one embodiment, microcontroller 230 is an application specific integrated circuit (ASIC). In the Bluetooth™ embodiment, microcontroller 230 is a separate central processing unit (CPU) core for managing RF device 200 and for handling some inquiries and requests without having to involve the host device 120. In the Bluetooth™ embodiment, microcontroller 230 runs software that discovers and communicates with other Bluetooth™ devices via the Link Manager Protocol (LMP). The LMP provides a number of services including sending and receiving of data, inquiring of and reporting a name or device identifier, making and responding to link address inquiries, connection setup, authentication, and link mode negotiation and setup. The LMP also can be used to place input/output device 108 in "sniff" mode, "hold" mode, "park" mode or "standby" mode.

Figure 3A:
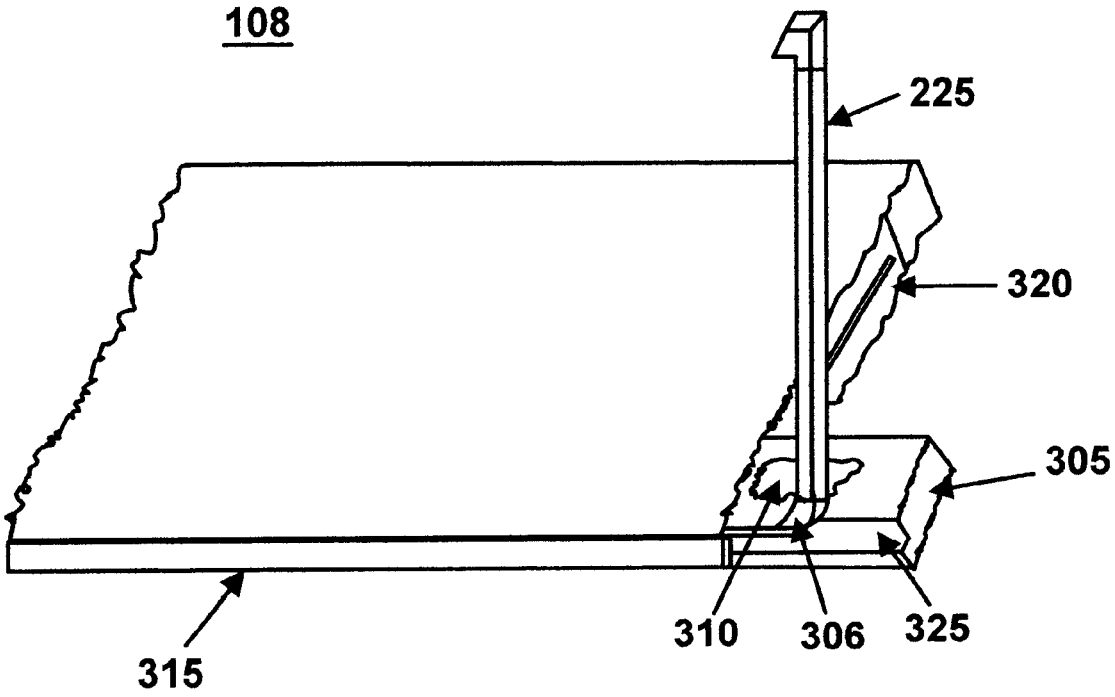
FIG. 3*a* is an illustration of a peripheral component with the antenna extended, according to one embodiment of the present invention.

Referring now to FIG. 3*a,* a peripheral component 108 with an extractable antenna 205 is illustrated. The receptacle 310 shown may be operable to receive. an RJ-11 plug, an RJ-45 plug, or the like. In this embodiment, the receptacle 310 is located on a receptacle platform 305. The receptacle platform 305 may be slid entirely into the housing 315, in one embodiment. However, other embodiments do not require the platform 305 to be retractable. The housing 315 may be a credit card sized and shaped shell. The platform 305 has a groove 325 or channel, which serves as an internal guide for the antenna 205. By placing the antenna 205 on the side of the receptacle platform 305, the antenna 205 requires only a very small amount of additional space. Consequently, the addition of the antenna 205 has a minimal impact on the logical circuitry within the peripheral component 108.

The peripheral component 108 also has a wireline interface 320, which may be compatible any of well known wireline connectors, such as IEEE 1394, SCSI, parallel, serial, etc. In a preferred embodiment the wireline interface is a 15-pin connector.

Figure 3B:
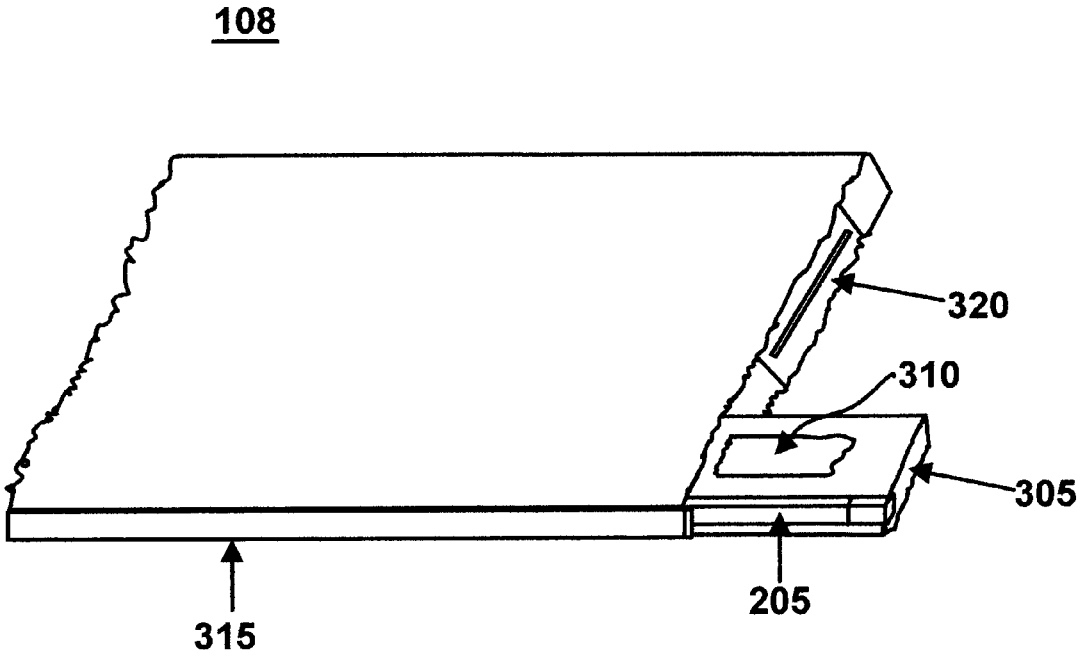
FIG. 3*b* is an illustration of a peripheral component with the antenna retracted, according to one embodiment of the present invention.

Referring now to FIG. 3*b,* the antenna 205 is shown resting along side of the receptacle platform 305. The receptacle platform 305 may be slid into the housing 315 to substantially hide the antenna 205. For example, when the receptacle platform 305 is pushed into the housing 315, the antenna 205 moves in with it. In this embodiment, the normal internal position of the antenna 205 is when the receptacle platform 305 is substantially fully inserted into the housing 315.

Referring again to FIG. 3*a,* the antenna 205 is shown in its extracted position. The antenna 205 may be drawn out of the housing 315, in a fashion similar to withdrawing on oil dipstick from an automobile. After withdrawal, the antenna 205 springs, or otherwise moves, to a pre-determined position. In the illustration, the antenna 205 is shown as forming a substantially 90 degree angle with the housing 315. This allows the antenna 205 to optimize wireless transmission and reception. However, the antenna 205 does not have to form a 90 degree angle. The optimum angle will depend upon factors such as the computer for which the peripheral component 108 is designed, which in turn may lead to considerations such as whether the antenna 205 will be blocked from standing in a given position when the peripheral component 108 is placed into its slot in the host computer 120.

The antenna 205 is made of a material which conforms to the shape of the housing 315 so that it may easily be pushed into or inserted into the housing 315. Additionally, the antenna 205 is made from a suitable material such that when it is extracted from the housing 315 it will return to a pre-determined position to receive and transmit wireless signals. Thus, the antenna 205 will have sufficient resiliency to repeatedly return substantially to its pre-determined shape even if the antenna 205 is kept in the internal position for extended periods of time.

When the antenna 205 is in the extracted position it must be electrically connected to the RF device 200. Clearly, it may also be electrically connected when the antenna 205 is in the internal position. Embodiments of the present invention may use any suitable method for making such a connection. In the preferred embodiment a micro-coax flex circuit is used. In other embodiments, a sliding contact, a pressure contact, or direct solder is used.

Still referring top FIG. 3*a,* in one embodiment, the antenna 205 has a flex point 306. However, other embodiments do not require the flex point 306. For example, the antenna 205 may form a continuous arc with no flex point 306 at all. In one embodiment, the antenna 205 is constructed out of a resilient and flexible metal, such as is often used to join the earpieces of stereo headphones. However, any material, otherwise suitable for an antenna, which possesses the qualities necessary to return substantially to a pre-determined shape after resting within the housing 315 may be used for the antenna 205.

In another embodiment, the receptacle platform 305 does not slide in and out of the housing 315. In this embodiment, the antenna slides in and out of the housing 315 without the receptacle platform 305 moving.

Figure 4A:
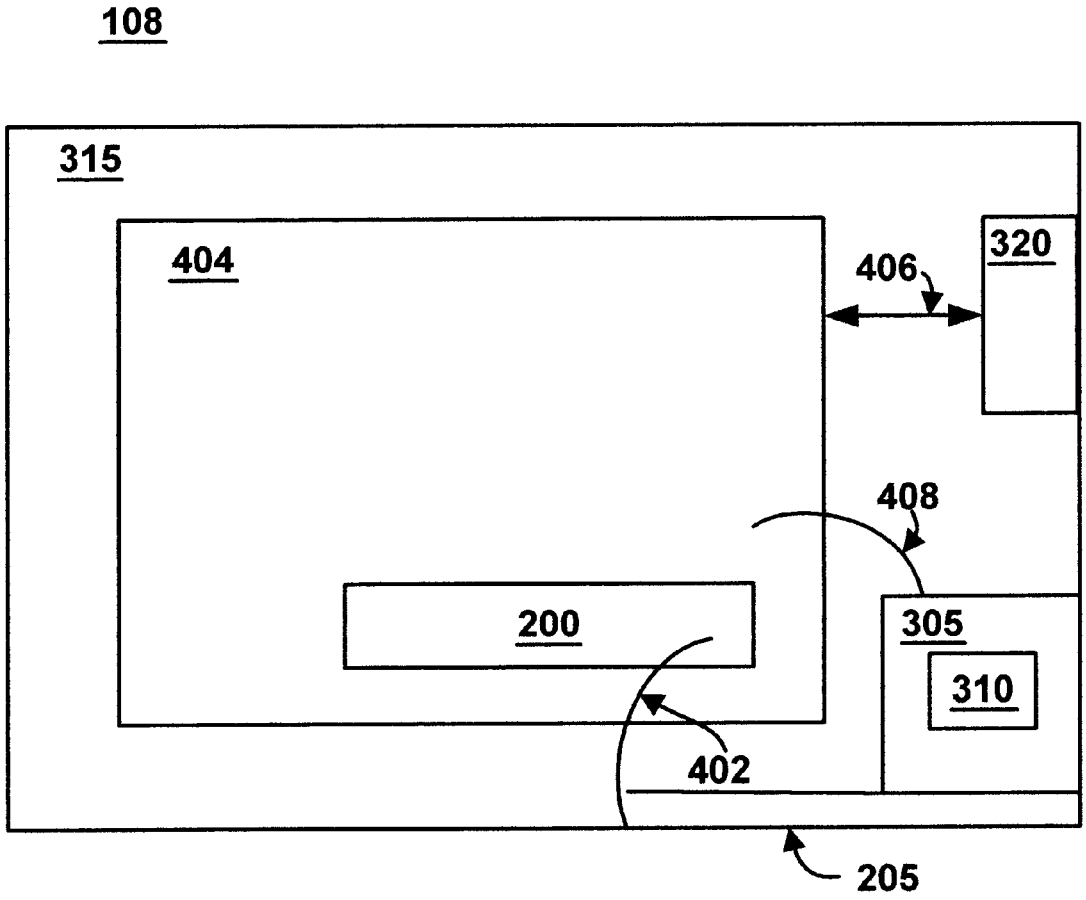
FIG. 4*a* is an illustration of the inside of a peripheral component with the antenna retracted, according to one embodiment of the present invention.

Referring now to FIG. 4*a,* the internal circuitry of the peripheral component 108 will be discussed in greater detail. In FIG. 4*a,* the receptacle platform 305 and the antenna 205 are both retracted inside of the housing 315. In this embodiment, the antenna 205 is connected to the RF device 200 via a micro coaxial flex circuit 402. Micro coaxial cables are well-known in the art. For example Precision Tube Company, Salisbury, Md. sells numerous suitable cables with outer cable diameters between 0.052 inches and 0.425 inches. Additionally M/A-Com, Waltham, Mass. sells numerous suitable cables. Cables may be manufactured with bend radii between 0.0625 inches and 0.375 inches. These cables are well suited to connecting an antenna to a wireless module in a confined space, such as a type II PCMCIA card with dimensions of 85.6 mm by 54 mm by 5.0 mm.

Figure 4B:
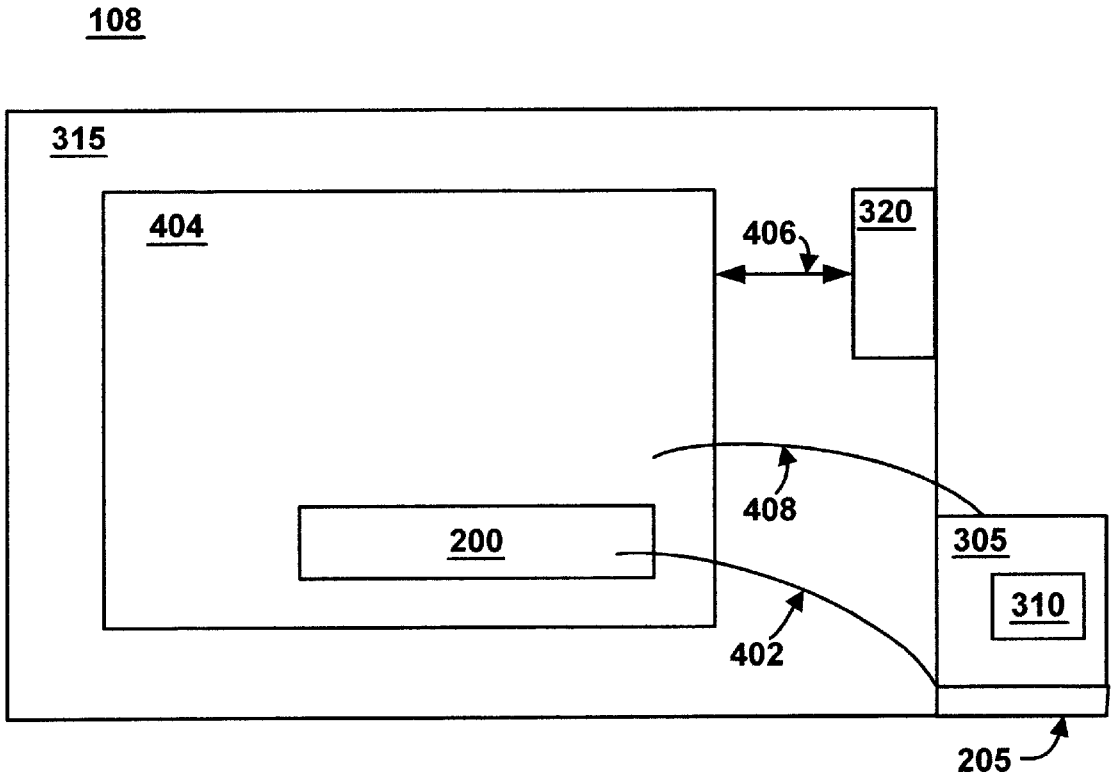
FIG. 4*b* is an illustration of the inside of a peripheral component with the antenna extended, according to one embodiment of the present invention.

FIG. 4B illustrates the antenna and receptacle platform 305 in the extracted position. Considering the dimensions of the peripheral component 108, micro coax cables are well-suited to connect the antenna 205 to the RF device 200, while allowing the antenna 205 to be moved from the retracted position (FIG. 4*a*) to the extracted position (FIG. 4*b*). The receptacle 310 may be connected to peripheral component logic 404 via a ribbon cable 408 or other suitable means. The wireline connector 320 is connected to the logical circuitry 404 by well known methods. Embodiments of the present invention are well-suited to connect the various interfaces to the logical circuitry 404 by other methods, as described herein and as known in the industry. In one embodiment, the logical circuitry 404 comprises a wireless device 200, for example, a Bluetooth™ device.

In summary, the present invention provides a peripheral component allowing multiple types of interfaces. Embodiments of the present invention allow a peripheral component with a receptacle interface, a wireline interface, and a wireless interface. Embodiments provide for a such a peripheral component being a type II PCMCIA card. Embodiments provide for such as device which minimally interferes with the logical circuitry inside the peripheral component.

The preferred embodiment of the present invention, a peripheral component allowing multiple types of interfaces, is thus described. While the present invention has been described in particular embodiments, it should be appreciated that the present invention should not be construed as limited by such embodiments, but rather construed according to the following claims.

What is claimed is:

1. A peripheral component comprising multiple types of interfaces, said peripheral component comprising:

a housing;

logical circuitry within said housing;

a receptacle electrically connected to said logical circuitry;

a wireline interface electrically connected to said logical circuitry; and a resilient antenna electrically connected to said logical circuitry, said antenna operable to conform to fit inside said housing and when extracted said antenna operable to return substantially to a pre-determined shape, wherein reception and transmission of a wireless signal are optimized.

2. The peripheral component of claim 1 wherein said antenna is slideably extractable from said housing.

3. The peripheral component of claim 1 wherein said receptacle interface is in a platform having a groove and said antenna slideably fits into said groove.

4. The peripheral component of claim 3 wherein said receptacle platform slideably extracts from and inserts into said housing, wherein said antenna extracts from and inserts into said housing along with said receptacle platform.

5. The peripheral component of claim 1 wherein said antenna has a flex point, an upper end, and a lower end, wherein when said antenna is extracted from said housing said resilient antenna flexes at said flex point wherein said upper end automatically forms an angle with said lower end such that wireless transmission through said antenna is optimized.

6. The peripheral component of claim 5 wherein said angle is substantially 90 degrees.

7. The peripheral component of claim 1 wherein said peripheral component is a PCMCIA card.

8. The peripheral component of claim 1 wherein said receptacle is adapted to receive an RJ-11 plug.

9. The peripheral component of claim 1 wherein said receptacle is adapted to receive an RJ-45 plug.

10. The peripheral component of claim 1 wherein said wireline interface is selected from a group consisting of: a serial interface, a parallel interface, and a SCSI interface.

11. The peripheral component of claim 1 wherein said logical circuitry comprises a wireless device and said antenna is electrically connected to said wireless device.

12. The peripheral component of claim 11 wherein said wireless device is a Bluetooth device.

13. The peripheral component of claim 1 further comprising a peripheral interface for connecting to a host device, said interface selected from a group consisting of: a Universal Serial Bus (USB) interface, a Personal Computer (PC) Card interface, a CardBus, a Peripheral Component Interconnect (PCI) interface, a mini-PCI interface, a Personal Computer Memory Card International Association (PCMCIA) interface, an Industry Standard Architecture (ISA) interface, and an RS-232 interface.

14. A type II Personal Computer Memory Card International Association (PCMCIA) card allowing multiple types of interfaces, said type II PCMCIA card comprising:

a housing;

logical circuitry within said housing, said logical circuitry comprising a wireless device;

a receptacle interface electrically connected to said logical circuitry;

a wireline interface electrically connected to said logical circuitry; and a resilient antenna electrically connected to said wireless device, said antenna operable to conform to fit inside said housing and when extracted said antenna operable to return substantially to a pre-determined shape, wherein reception and transmission of a wireless signal are optimized.

15. The type II PCMCIA card of claim 14 wherein said antenna is connected to said wireless device via a micro-coaxial cable.

16. The type II PCMCIA card of claim 14 wherein said receptacle is operable to receive a plug selected from a group consisting of: an RJ-11 plug, and an RJ-45 plug.

17. The type II PCMCIA card of claim 14 wherein said receptacle is an X-Jack.

18. The type II PCMCIA card of claim 14 wherein said wireline interface is selected from a group consisting of: a serial interface, a parallel interface, and a SCSI interface.

19. The type II PCMCIA card of claim 14 wherein said antenna is slideably extractable from said housing.

20. The type II PCMCIA card of claim 14 wherein said wireless device is a Bluetooth device.

* * * * *